M7219 XR 4,325,438

United States Patent [19]

Zuvela

[11] 4,325,438

[45] Apr. 20, 1982

[54] LENGTHENING DRILL STRING CONTAINING AN INSTRUMENT

[75] Inventor: Bernard R. Zuvela, Fountain Valley, Calif.

[73] Assignee: Scientific Drilling Controls, Irvine, Calif.

[21] Appl. No.: 133,319

[22] Filed: Mar. 24, 1980

[51] Int. Cl.[3] ..... E21B 47/12

[52] U.S. Cl. ..... 175/50; 175/45; 175/104; 175/320; 166/65 R

[58] Field of Search ..... 175/40, 45, 61, 62, 175/85, 320, 50, 57, 104, 257; 166/65 R; 174/47; 339/16 R, 16 C R; 254/134 R, 134 CL, 134 PA

[56] References Cited

U.S. PATENT DOCUMENTS

| | | | |
|---|---|---|---|
| 2,232,360 | 2/1941 | Barnett | 174/47 X |
| 2,249,769 | 7/1941 | Leonardon | 324/10 |
| 2,370,818 | 3/1945 | Silverman | 175/50 X |
| 2,706,616 | 4/1955 | Osman | 175/104 X |
| 3,285,629 | 11/1966 | Cullen et al. | 175/104 X |
| 3,825,078 | 7/1974 | Hellhecker et al. | 175/104 X |
| 3,913,688 | 10/1975 | Hellhecker et al. | 175/320 |
| 4,001,774 | 1/1977 | Dawson et al. | 175/50 X |
| 4,098,342 | 7/1978 | Robinson et al. | 175/40 X |
| 4,143,721 | 3/1979 | Zuvela et al. | 175/40 |
| 4,153,120 | 5/1979 | Zuvela | 175/45 X |

FOREIGN PATENT DOCUMENTS

| | | | |
|---|---|---|---|
| 166011 | 6/1934 | Switzerland | 175/19 |

*Primary Examiner*—James A. Leppink
*Attorney, Agent, or Firm*—William P. Green

[57] ABSTRACT

A pipe section is added to a drill string while an instrument and a flexible line leading to the instrument remain in the string. The effective length of the flexible line is increased in corresponding with the increase in length of the drill string by connection of the flexible line to a carrier by which the line is carried in a coiled condition occupying a distance longitudinally of the drill string shorter than the actual length of the line. The carrier is constructed to pay out the different turns of the coiled line successively from coiled condition to a straightened condition in a manner progressively increasing the effective length of the line. Preferably, the line is paid out from the carrier by pulling the carrier toward the outer end of the drill string while an inner end of the line is connected to the instrument in the string. The pulling force may be applied to the carrier through a second flexible line which is detachably connectable physically to the carrier and electrically to the first mentioned line and preferably extends through a circulating fluid head.

36 Claims, 8 Drawing Figures

FIG. 3
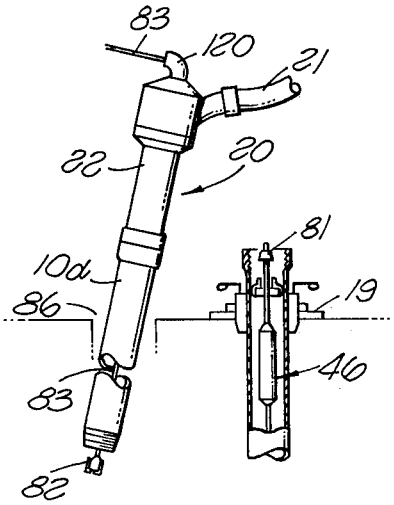
FIG. 4
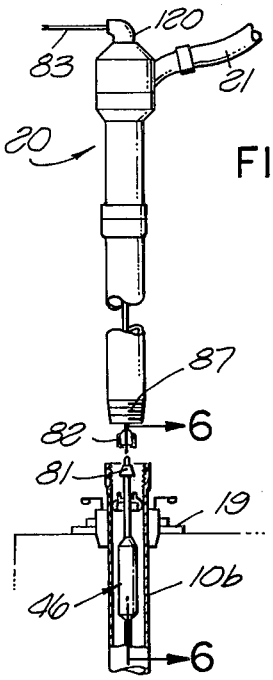
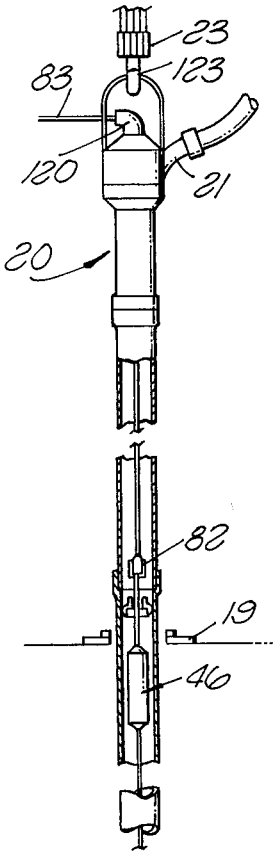
FIG. 5
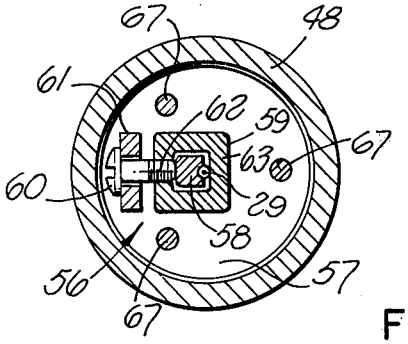
FIG. 7
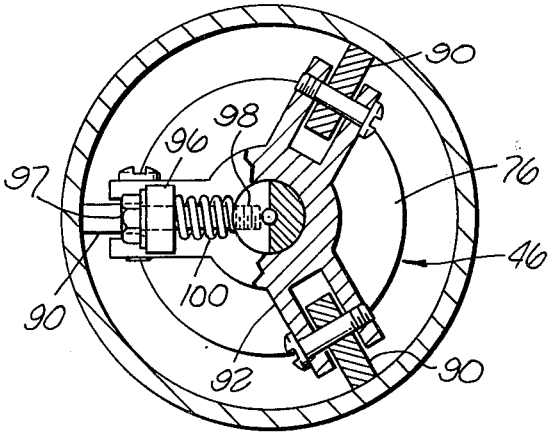
FIG. 8

LENGTHENING DRILL STRING CONTAINING AN INSTRUMENT

BACKGROUND OF THE INVENTION

This invention relates to improved apparatus and methods for facilitating the connection of added pipe sections into a drill string which contains an instrument connected by a flexible conductive line to a readout unit or other unit at the surface of the earth. Though it will be apparent that the invention is applicable broadly to the drilling of a well or hole in any direction into the earth, that is, either vertically, horizontally (as in coal mining operations), or at any selected inclination, the invention will be described primarily as applied to the drilling of a vertical well.

During many drilling operations, it is helpful to provide within the drill string an instrument which can sense or respond to condition or conditions in the well, or which can serve some other useful purpose relating to the drilling process. One such instrument often employed in a drill string is a device capable of sensing the inclination of the string and the azimuth of that inclination at any particular instant, to provide information indicating to a driller what steps are necessary or desirable in order to assure that continued drilling occurs along a desired path and will ultimately reach a particular target area in the earth formation. An instrument capable of monitoring inclination and the azimuth of the inclination during drilling is shown in U.S. Pat. No. 3,791,043, and includes an instrument probe to be contained in the drill string and connected by a flexible conductive line to a readout unit at the surface of the earth on which the inclination and azimuth are indicated. An improved probe for this purpose is shown in U.S. Pat. No. 3,862,499.

U.S. Pat. Nos. 4,143,721 and 4,153,120 disclose methods and apparatus for use in conjunction with inclination instruments of the above-discussed types, or other instruments which are connected to surface equipment by a flexible conductive line, and which apparatus and methods are especially designed to enable the instrument and its flexible line to remain in the drill string while a pipe section is being added to the outer end of the string to increase its length. If the instrument and line can be left in the string during such addition of a section to its outer end, a great deal of time and effort can be saved as compared with the time and effort expanded under the more conventional procedure of completely withdrawing the instrument and line from the drill string each time that a section is added.

Other arrangements having a flexible line which is left in a drill string while a pipe section is added to the string are shown in U.S. Pat. Nos. 3,825,078; 3,825,079; and 3,913,688. In those patents, the line is passed about guides in a sheave or pulley system in a manner causing a weighted loop of the line to be shortened when the upper end of the line is pulled upwardly. The patents mention in a very general way that the line may be arranged in the drill string in a wound, helical, coiled, looped, folded, overlapped or other convoluted configuration, but contain no teaching as to any such configuration other than the above discussed pulley system.

SUMMARY OF THE INVENTION

The purpose of the present invention is to provide improved apparatus and methods for attaining the abovediscussed object of enabling a pipe section to be added to a drill string while an instrument and connected flexible conductive line remain in the string. The concepts of the present invention enable a pipe section to be added to the outer end of the drill string by essentially the same procedure utilized in instances in which no instrument and flexible line are present, and with the added manipulative effort necessitated by presence of the instrument and line being at a minimum.

To achieve these results, I utilize in the drill string a unit which carries a portion of the flexible line in a coiled condition occupying a distance longitudinally of the drill string much shorter than the distance which the line would occupy if it were stretched out to full length in a linear condition within the string. In order to compensate for the increase in length of the drill string which occurs as a result of the addition of an added pipe section to the outer end of the string, this line carrier is constructed to progressively pay out the different turns of the coiled line successively, with each turn converting from a coiled condition to a straightened condition as it leaves the carrier, in a manner progressively increasing the effective length of the line in correspondence with the increase in length of the drill string. This process is repeated for each pipe section added to the string, until ultimately the entire flexible line is extended out to straight line condition. The carrier is preferably contained in the drill string at a location near the surface of the earth, and may be mounted for movement longitudinally within the drill string and toward the surface of the earth, and be constructed to pay out the coiled line in response to such movement. The carrier may be provided with a friction element for resisting movement of the flexible line out of the carrier, to prevent the line from being payed out unintentionally and as a result of movement of fluid in the string or other forces. Also, the carrier may have gripping means for contacting the inner wall of the drill string and acting to prevent movement of the carrier more deeply into the drill string while permitting it to be pulled outwardly toward the outer end of the string as discussed.

The outward movement of the carrier may be effected by exertion of pulling force by a second flexible line which is connected to the readout unit at the surface of the earth. This second flexible line may be detachably connectable to the carrier to apply pulling force thereto, and be electrically connectable to the first mentioned flexible line to receive electrical signals from the instrument. The second flexible line may extend through a head which supplies circulating fluid to the drill string, and may exert pulling force against the carrier by detaching the circulating head from the drill string and moving the circulating head axially away from the drill string. The connection or connections between the two flexible lines may be broken when a pipe section is to be added to the string, with the second flexible line then being threaded through the additional pipe section before reconnection to the main line and instrument within the string.

BRIEF DESCRIPTION OF THE DRAWINGS

The above and other features and objects of the invention will be better understood from the following detailed description of the typical embodiment illustrated in the accompanying drawings, in which:

FIGS. 2, 3, 4 and 5 show the apparatus of FIG. 1 during four successive steps of the process of adding a pipe section to the upper end of the drill string;

FIG. 7 is a fragmentary section taken on line 7—7 of FIG. 6; and FIG. 8 is a horizontal section taken on line 8—8 of FIG. 6.

DESCRIPTION OF THE PREFERRED EMBODIMENT

Figure 1:
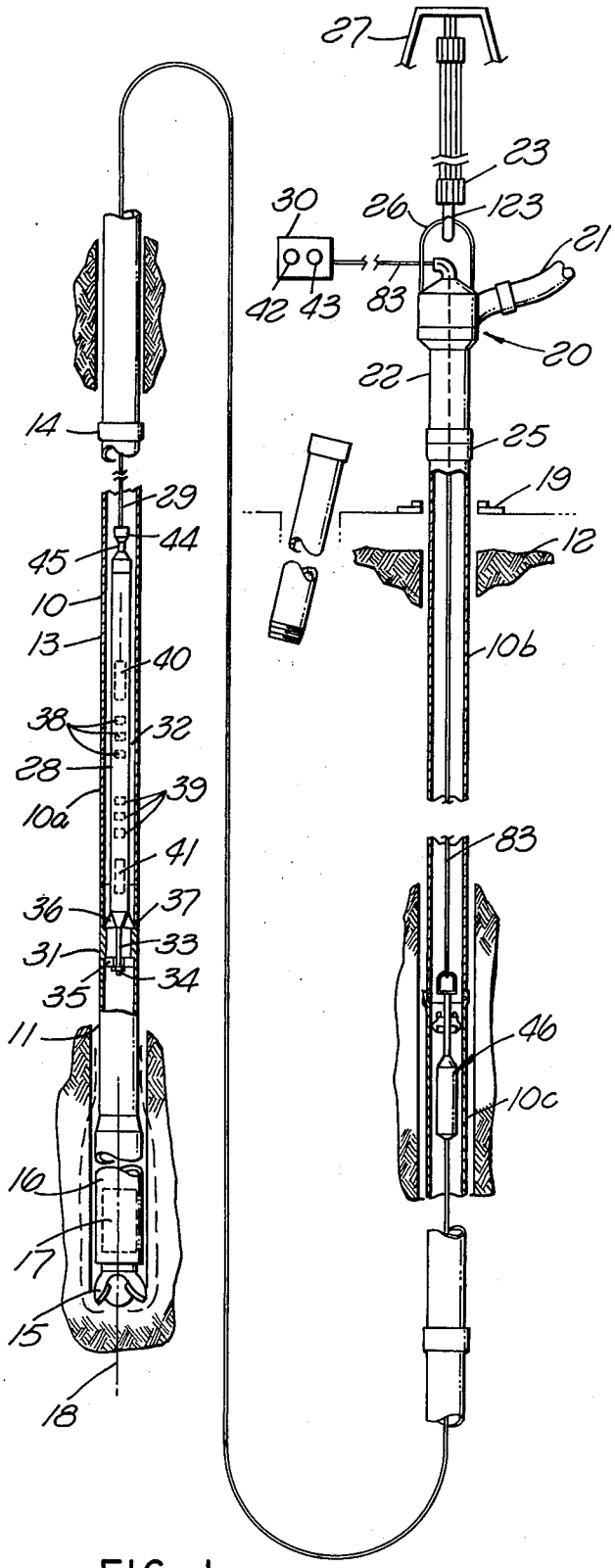
FIG. 1 is a view representing well drilling apparatus utilizing the present invention, the view being primarily a vertical section through a well being drilled vertically into the earth, with the apparatus being illustrated in FIG. 1 as it appears just prior to the connection of an added pipe section into the upper end of the drill string.

The apparatus illustrated in FIG. 1 includes a drill string 10 for drilling a hole 11 into the earth. The surface of the earth is represented at 12 in FIG. 1, and the well is illustrated in that figure as extending directly vertically downwardly into the earth, though as previously mentioned the invention is equally applicable to the drilling of a hole which is horizontal or inclined at any angle. When the well is to extend horizontally into the earth, the mechanism for advancing the string and driving the drill bit may be of any conventional type, such as the apparatus illustrated in U.S. Pat. Nos. 4,143,721 and 4,153,120.

The drill string 10 is formed of a series of pipe sections 13 connected together in end to end fashion at threaded joints 14 and carrying a bit 15 which acts by rotation to drill the hole 11 in the earth. The drawings illustrate the apparatus as of a type in which the drill string 10 does not itself rotate, but rather carries at its lower end a self-contained drilling unit 16, having a motor 17 which acts to turn bit 15 about the longitudinal axis 18 of the drill string. This motor 17 may be energized and driven by the pressure of drilling fluid which is forced downwardly through the interior of the drill string to the bit location, and then flows upwardly within the annulus about the drill string to carry the cuttings to the surface of the earth. It will of course be understood that the invention may also be applied to drilling equipment in which the string 10 is itself driven rotatively about axis 18 by a conventional rotary table 19 at the surface of the earth, with a kelly, kelly bushing, and other related equipment then being provided to drive and handle the string.

Circulating fluid is introduced into the upper end of the drill string 10 through a circulating head 20 into which the circulating fluid is introduced under pressure through a flexible hose 21. The circulating head 20 carries a short pipe section or 'crossover' 22 having a lower externally threaded pin end 24 connectable into the upper internally threaded box end 25 of the drill string. Circulating head 20 is suspended from the traveling block 23 by a hook 123 engaging a bail 26 on the circulating head. The traveling block 23 is part of the usual block and tackle mechanism suspended from the upper end of the derrick 27 and power actuable by draw works to raise and lower the circulating head.

The drill string 10 contains near its lower end an instrument 28 which may typically be an inclinometer probe of the type disclosed in U.S. Pat. No. 3,791,043 or U.S. Pat. No. 3,862,499, with the probe being electrically connected by a flexible line 29 to a readout unit 30 at the surface of the earth as in those patents. Probe 28 may be magnetically responsive to the earth's magnetic field, and if so is contained within a non-magnetic section 10*a* of the drill pipe 10. The lower end of the instrument probe 28 may be anchored within an attaching sub 31 connected into the string between section 10*a* and the drill unit 16. Instrument 28 may be located centrally within section 10*a* in a position of extension along the main axis 18 of the drill string, with a space 32 being left about probe 28 to pass pressurized circulating fluid downwardly past the instrument and to the drilling unit. For attaching the lower end of probe 28 rigidly to sub 31 in centered relation, the lower or inner end of the probe may carry an externally threaded row 33 carrying a nut 34 which is tightenable upwardly against the central portion of a fluid passing spider 35 in sub 31. Tightening of nut 34 on rod 33 pulls a series of circularly spaced radially projecting fins 36 on the lower end of probe 28 downwardly against an upwardly facing shoulder 37 formed in the sub, to clamp the instrument in the desired centered position. Any other type of connection between the instrument and the drill string may of course be substituted for the one typically illustrated.

The instrument probe 28 may contain three magnetic sensing elements 38 responsive to different components of the earth's magnetic field, along three mutually perpendicular axes, to sense directional orientation of the probe relative to the earth's field. The instrument probe also may contain three gravity responsive elements 39 which sense inclination of the same three mutually perpendicular reference axes with respect to the vertical. Electronic circuitry 40 contained within the probe 28 may be energized by a battery 41 and be responsive to the sensing elements 38 and 39 to produce signals which are fed to the surface of the earth through line 29 in multiplex form. The readout unit 30 responds to these signals and may include dials or other indicators 42 and 43 producing output indications representing the inclination of the probe with respect to the vertical, the azimuth of that inclination, and any other desired information helpful to the drilling operation. The flexible line 29 is preferably a single conductive wire of copper or the like, insulated by nylon or other insulating material capable of withstanding substantial wear without damage. The inner or lower end of insulated line 29 is mechanically connected to an element 44 which is attached by a frangible connector 45 to the outer end of probe 28, in a manner enabling the connection at 45 to be broken by exertion of pulling force on line 29 from the surface of the earth when desired. To attain this result, the frangible connection 45 has substantially less strength than does line 29 or the element 44 or probe 28 or its attachment at 33–34–35 to the drill string. The conductive wire within line 29 extends downwardly through elements 44 and 45 but is insulated therefrom electrically, and is connected to the solid state electronic equipment 40 within probe 28, to receive the multiplexed signals from that unit.

In accordance with the present invention, the upper end of the insulated conductive line 29 is connected to a carrier or shuttle 46, which is in turn detachably connectable to a second insulated flexible conductive line 83 leading to the readout unit 30. The structure of a presently preferred form of the shuttle 46 is illustrated in detail in FIG. 6. As seen in that figure, the shuttle may include an outer fluid-tight housing or case 47, preferably having a vertical cylindrical side wall 48 centered about the main longitudinal axis 18 of the drill string and closed at its lower end by a bottom wall 49 except at the location of a vertically extending central passage 50 through which line 29 extends between the interior and exterior of case 47. Passage 50 may be dimensioned to fit closely about line 29, with an O-ring 51 preferably being carried by body or case 47 about the line to form a fluid-tight seal between the interior and exterior of the case.

An extended length of the flexible insulated conductive line 29 is contained within body 47 in the form of a coil 52 of the insulated wire, with the coil being desirably centered about the longitudinal axis 18 of case 47 and the drill string and being wound in several layers 53. The outer layer of the coiled wire may be in direct engagement with the inner cylindrical surface 54 of body 47, with the inner layers being wound progressively therein, and with the wire 29 extending downwardly from the innermost one of these layers toward the outlet opening or passage 50 in the bottom of the case. The different turns of line 29 which form coil 52 desirably have sufficient stiffness to tend to remain in their illustrated coiled condition, but are also flexible enough to be pulled downwardly through bottom passage 50, so that the initially coiled wire may be progressively payed out downwardly in a straight line condition from the shuttle. For further assisting in retaining the wire in its coiled condition until it is forcibly pulled downwardly from body 47, the different turns of wire forming coil 52 may be bonded together by an appropriate resinous plastic material or other bonding substance represented at 55, typically an epoxy cement, contacting all of the turns of the coil, with the epoxy being adapted to be progressively broken by each turn of the coil as that turn is pulled downwardly, while retaining the other turns in their coiled condition until each turn is individually pulled downwardly and straightened to vertical linear condition.

A friction unit 56 may be provided within the lower portion of the body or case 47, and may act to apply an adjustable and controllable frictional resistance to downward movement of the conductive line 29, to thereby prevent the line from paying out unintentionally, as for instance under the influence of the downwardly moving circulating fluid within the drill string. The friction unit may typically include a main part 57 having a gripping member 58 engaging one side of line 29, with a tubular element 59 being disposed about gripping part 58 and wire 29 and acting to engage the opposite side of the wire in clamping relation. An adjusting screw 60 extending through an upstanding portion 61 of part 57 may be threadedly connected into a side wall of the tube 59 at 62, to pull the tube leftwardly in FIG. 6 and cause the portion 63 of the tube to clamp against line 29.

At a location above unit 56, the body 47 of the shuttle may contain a wiper unit 64 disposed about line 29 and containing a substance 65 which is engageable with the wire in a manner wiping therefrom any foreign materials before the line passes downwardly to the exterior of case 47. For example, the wiper 64 may function to prevent any debris formed by the bonding material 55 from passing downwardly into the well. Wiper 64 may be carried by a transverse plate 66 appropriately secured to the part 57 as by connector post structures 67. A tubular spacer part 68 may be contained within and line the tubular body 47 beneath coil 52, and may form a tapering throat 69 for assisting in directing the wire downwardly from the coil and toward the bottom exit passage 50.

The upper end of the shuttle body 47 may be closed by a cover 70 threadedly connected onto the side wall 48 at 71 and sealed with respect thereto by an O-ring 72, with the wire 29 extending upwardly through a central passage 73 in the top wall 74 of part 70. An O-ring 75 may form a seal between the line 29 and passage 73 in part 70.

To the upper end of cover part 70, there is connected a member 76, threadedly attached to part 70 at 77, and sealed with respect thereto by an O-ring 78. Part 76 contains a central vertical passage 79 extending along the longitudinal axis 18 of the apparatus and dimensioned to closely receive the upper end of insulated line 29.

The upper reduced diameter portion 80 of part 76 has a connector structure 81 at its upper end for providing a mechanical and electrical connection to a coacting connector 82 attached to a second flexible conductive line 83 leading to readout unit 30. Connector structure 81 may include an upper somewhat enlarged head 84 formed by the upper extremity of portion 80 of part 76 and shaped to function as an overshot connector engageable with a fishing tool to pull the shuttle out of the well if it becomes necessary to fish for the shuttle. Head 84 may have the upwardly tapering external configuration illustrated in FIG. 6, and provide a transverse horizontal annular shoulder 85 at its underside for engagement with a lifting tool.

Figure 6:
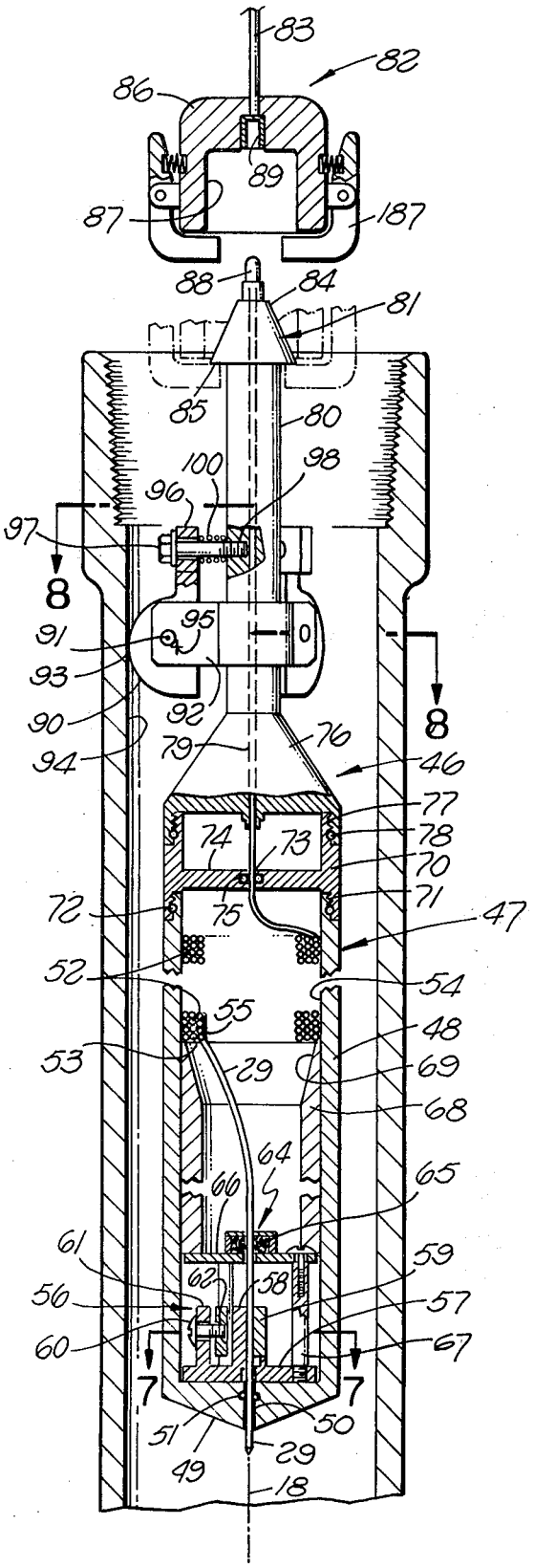
FIG. 6 is an enlarged fragmentary vertical section taken on line 6—6 of FIG. 4.

The connector 82 may take the form of a hollow inverted cup member 86 containing a downwardly facing recess 87 within which head 81 can be received, so that the part 86 can be moved downwardly about head 84 to the broken line position of FIG. 6 in which spring-pressed latching elements 187 or other elements may be releasably engaged with the undersurface 85 of overshot connector head 84 to enable pulling force to be exerted upwardly on the shuttle by line 83 through the connectors 81 and 82. Such mechanical connection of the parts 81 and 82 may also serve to form an electrical connection between the wire within flexible line 29 and the wire within flexible insulated line 83. For this purpose, the upper end of the conductor within line 29 may be electrically connected to an upwardly projecting pin contact 88, receivable within a coacting socket contact 89 carried by connector 82 and electrically connected to the wire within line 83. The contacts 88 and 89 are of course appropriately insulated from the metal elements with which they are associated. The second side of the electrical circuit can be completed through the drill string itself.

In order to support the shuttle 46 within the drill string at any desired location, the part 76 at the upper end of the shuttle may carry a number of circularly spaced camming friction elements 90, or other appropriate means for contacting the drill pipe in supporting relation. In a preferred arrangement, three of the elements 90 are provided, at evenly circularly spaced locations, with each of the elements being pivotally connected at 91 to a bearing bracket 92 projecting radially outwardly from the reduced diameter portion 80 of part 76. The pivotal axis at 91 for each of the elements 90 may extend directly horizontally, with all of these axes lying in a common horizontal plane disposed perpendicular to the longitudinal axis 18 of the drill string and the shuttle. Each of the parts 90 may have a gripping surface 93 which is engageable with the inner surface 94 of the drill string and is eccentric with respect to the axis 91 about which element 90 pivots. More particularly, the surface 93 may be centered about an axis 95 offset beneath and desirably slightly radially inwardly from axis 91, but parallel to that axis 91. As a result, clockwise pivotal movement of element 90 in FIG. 6 tends to tighten the gripping engagement of its surface 93 with the surface 94 of the drill pipe, while counterclockwise pivotal movement releases that gripping action. The releasing action may be limited by engagement of an upwardly projecting arm 96 of element 90 with the head 97 of a screw 98 connected threadedly and adjustably into portion 80 of part 76. A spring 100 yieldingly urges the eccentric friction part 90 in a counterclockwise direction, while rotary adjustment of screw 98 will pull the element in a clockwise direction and adjust the frictional resistance offered by that part to upward movement of the shuttle within the drill pipe. Downward movement of the shuttle relative to the drill pipe is prevented by virtue of the eccentricity of surface 93 with respect to the pivotal axis of part 90.

To describe the manner of operation of the above discussed equipment in use, and with particular reference first of all to FIG. 1, during a drilling operation circulating fluid is fed to the upper end of the drill string through circulating head 20, and flows downwardly through the string to drilling unit 16 to drive its motor 17 and the bit 15, with the resultant cuttings being carried upwardly by the circulating fluid about the drill string. As the drilling progresses, the bit 15 and drill string 10 move progressively downwardly into the deepening well bore 11, with the circulating head 20 also moving downwardly as the uppermost drill pipe section **10*b* advances from the position of FIG. 5 to the position of FIG. 1. During such advancement, the shuttle 46 is contained within the upper end of the second pipe section 10*c*, as seen in FIG. 1, being supported at that location by gripping elements 90. These elements 90 act to very positively prevent movement of shuttle 46 downwardly within the drill string, and are also set by their adjusting screws 97 to positions in which the eccentric elements 90 offer some frictional resistance to upward movement of the shuttle relative to the drill pipe, to thereby maintain the shuttle in fixed position within the pipe while permitting upward movement toward the surface of the earth when a pulling force is exerted on the shuttle by line 83**.

At any time during the drilling operation, the inclination at which the drill is advancing into the earth, and the azimuth of that inclination, can be determined by reference to the indicator gauges or elements 42 and 43 on unit 30 at the surface of the earth. If an incorrect direction is noted, steps may be taken to correct the direction of advancement of the drill.

Figure 2:
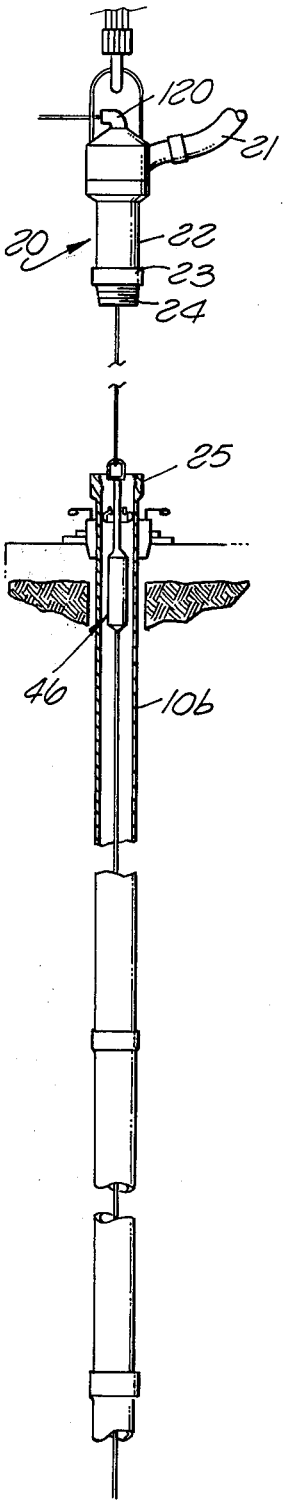

When the drilling has advanced to the point represented in FIG. 1, in which the upper end of the uppermost pipe section **10*b* of the drill string is located just above the level of the rotary table 19, the crossover sub 22 may be unscrewed from the upper box joint end 25 of section 10*b* as represented in FIG. 2. After the pin end 24 of crossover 22 has been unscrewed from box end 25 of section 10*b*, circulation head 20 and crossover 22 are pulled upwardly by traveling block 23 to correspondingly pull upwardly the connected shuttle 46. This upward movement is continued until the shuttle has been moved from its initial position in the upper end of section 10*c* to a corresponding position (FIG. 2) in the upper end of section 10*b*. The frictional engagement between gripping elements 90 and the side wall of the drill string offers some resistance to such upward movement of the shuttle, but is light enough to be overcome by the pulling force exerted by line 83. The line 83 extends upwardly through the interior of tubular crossover 22, and through the center of circulation head 20, and leaves the upper end of the circulating head through a tube 120 for connection to unit 30. Line 83 is a tight enough fit within tube 120 to effectively lock line 83 against downward movement relative to circulating head 20, or is otherwise locked or clamped against movement relative to the circulating head, to effectively transmit upward movement of the circulating head to line 83** and thereby exert the desired upward pulling force on the shuttle.

When the shuttle has reached the position of FIG. 2, in which connector structure 81 at the upper end of the shuttle is received just slightly above the upper extremity of pipe section **10*b*, the connection between units 81 and 82 is broken, as by manually pressing the upper ends of pivoting latch elements 87 inwardly to release their engagement with shoulder 85 and permit connector 82 to be pulled upwardly away from connector 81. With line 83 thus detached from the shuttle, circulating head 20 is moved laterally as represented in FIG. 3, and the flexible conductive line 83 with its connector end 82 is threaded downwardly through a pipe section 10*d* contained within mousehole 86 at a side of the rotary table, as represented in FIG. 3. Line 83 is of a length slightly greater than the length of each of the pipe sections 10*a*, 10*b*, 10*c*, 10*d*, etc., so that in the FIG. 3 condition, the connector 82 at the lower end of line 83 is received just slightly beneath the lower box end 87 of pipe section 10*b*. After sub 22 has been threadedly connected to the upper end of section 10*b* as illustrated in FIG. 3, the circulating head 20 and connected sections 22 and 10*d* are moved laterally to the FIG. 4 position of reception above the upper end of pipe section 10*b* in the rotary table (with that section and the string being suspended by slips in the rotary table). The assembly carried by the circulating head 20 is held in the FIG. 4 position just above the upper end of section 10*b* long enough for connector 82 to be pressed downwardly about connector 81, to the broken line position of FIG. 6 in which these connectors form a mechanical connection by which line 83 can exert upward force on the shuttle, and an electrical connection between conductive lines 29 and 83. The circulating head 20 and connected parts are then lowered to bring threaded pin end 87 of section 10*d* into engagement with the upper threaded box end 25 of section 10*b*, following which section 10*d* is rotated in any convenient manner to screw the two joint ends 87 and 25 together as illustrated in FIG. 5. The slips 88 may then be removed from the rotary table, and circulating fluid under pressure can be supplied to head 20 to again drive bit 15 in a continuation of the drilling action. Drilling is continued in this manner until the apparatus again reaches the FIG. 1 condition, at which another added pipe section can be added to the upper end of the string in the manner discussed in connection with 10*d***.

While a certain specific embodiment of the present invention has been disclosed as typical, the invention is of course not limited to this particular form, but rather is applicable broadly to all such variations as fall within the scope of the appended claims.

I claim:

1. Apparatus comprising:

a drill string including a series of interconnected pipe sections;

an instrument contained in said string;

a flexible conductive line connected electrically to said instrument and extending toward the surface of the earth;

a unit at the surface of the earth electrically connected to said flexible line; and a carrier contained in the string and carrying a portion of said flexible line in the form of a coil of many turns occupying a distance longitudinally of the drill string shorter than the length of the coiled portion of the line;

said coil being so wound as to pay out different turns of said coil successively from the carrier, and from coiled condition to a straightened condition, in response to exertion of a pulling force longitudinally of the drill string between said carrier and line while the carrier is contained in the string, to thereby increase the effective length of the line and compensate for addition of a pipe section to the string.

2. Apparatus as recited in claim 1, in which said carrier includes a hollow body, said coil being contained within said hollow body and including a plurality of layers of said line wound one about the other, a portion of said line which extends from said body being connected to the innermost of said layers of line in the coil in a relation to progressively unwind the line from the interior of the coil.

3. Apparatus as recited in claim 1, including a binder material retaining said line in said coiled condition and adapted to be progressively broken to release the different turns of the coil successively by the exertion of longitudinal pulling force between the line and said carrier body.

4. Apparatus as recited in claim 1, in which said carrier includes a unit engaging said flexible line and permitting movement of said line from the carrier but offering resistance thereto to maintain the line beyond the carrier in generally linear condition.

5. Apparatus as recited in claim 1, in which said carrier includes a wiper engaging and cleaning the line as it discharges from the carrier body.

6. Apparatus as recited in claim 1, in which said coil is wound essentially about an axis extending longitudinally of the drill string.

7. Apparatus comprising:

a drill string including a series of interconnected pipe sections;

an instrument contained in said string;

a flexible conductive line extending from said instrument toward the surface of the earth;

a unit at the surface of the earth electrically connected to said flexible line; and a shuttle contained in the string near the surface of the earth and carrying a portion of said flexible line in the form of a coil of many turns occupying a distance longitudinally of the drill string shorter than the length of the coiled portion of the line;

said shuttle being movable within and relative to the drill string toward the surface of the earth when a pipe section is added to the string;

said coil being so wound as to pay out the different turns of said coil successively from coiled condition to straightened condition by exertion of a pulling force longitudinally of the drill string between said line and shuttle during and as a result of such movement of the shuttle toward the surface of the earth and while the shuttle remains in the drill string, and in a relation increasing the length of the line between said instrument and said shuttle to compensate for the increase in length of the string.

8. Apparatus as recited in claim 7, including a conductor at the surface of the earth through which said line is connected to said unit, and electrical connector members for connecting said flexible line to said conductor and which are detachable to enable an additional pipe section to be connected into the drill string.

9. Apparatus as recited in claim 7, including means for pulling said shuttle toward the surface of the earth to increase the effective length of said line.

10. Apparatus as recited in claim 7, including a second conductive flexible line for connecting said first mentioned flexible line electrically to said unit at the surface of the earth and operable to pull said shuttle toward the surface of the earth to increase the effective length of said first line.

11. Apparatus as recited in claim 7, including a circulating head through which circulating fluid is delivered to the drill string, and a second conductive flexible line extending through the circulating head for connecting said first mentioned flexible line to said unit at the surface of the earth.

12. Apparatus as recited in claim 11, including connector means for detachably connecting said second flexible line to said first line electrically, and to said shuttle in a relation to pull the shuttle toward the surface of the earth.

13. Apparatus as recited in claim 11, including connector means carried by said second line and detachably connectable to said first line and said shuttle, said second flexible line having a portion projecting beyond said circulating head and carrying said connector means and of a length to extend through an added pipe section attached to the circulating head in a relation enabling attachment of said connector means to the first line and shuttle before the added pipe section is attached to the outer end of the drill string.

14. A device for use in a drill string containing an instrument to be electrically connected with a unit at the surface of the earth, comprising:

a carrier adapted to be contained within the drill string; and a flexible conductive line for connecting said instrument electrically to said unit and carried by said carrier in the form of a coil of many turns occupying a distance longitudinally of the string shorter than the length of the coiled portion of the line;

said coil being so wound as to pay out different turns of said coil successively from the carrier, and from coiled condition to a straightened condition in response to exertion of a pulling force longitudinally of the drill string between said carrier and line while the carrier is contained in the string, to thereby increase the effective length of the line and compensate for addition of a pipe section to the string.

15. A device as recited in claim 14, including connector means at an upper end of said carrier detachably connectable to a second flexible line for connecting said first line electrically to said unit.

16. A device as recited in claim 14, in which said carrier has a portion engageable with a pulling tool by which the carrier can be pulled longitudinally within the drill string and toward the surface of the earth to increase the effective length of said line.

17. A device as recited in claim 14, in which said carrier includes a hollow body containing said coil in a position of extension generally about the longitudinal axis of the drill string and from the interior of which the line pays out progressively, said carrier including binding material retaining said line in coiled condition and adapted to be progressively broken to release the line from the coil, a friction drag unit for yieldingly resisting movement of the flexible line from said body, a plurality of friction cam elements carried by the body and engageable with a drill string in a relation preventing movement of the body more deeply into the drill string and permitting movement of the body toward the surface of the earth, and a connector structure at the upper end of the carrier body attachable to a second flexible line an a relation enabling said second line to pull the carrier upwardly toward the surface of the earth and connecting said second line electrically to said first line.

18. A device as recited in claim 17, in which said coil is wound essentially about an axis extending longitudinally of the drill string.

19. The method that comprises:

drilling a hole into the earth utilizing a tubular drill string which is formed of interconnected pipe sections and which contains an instrument, a flexible conductive line for connecting the instrument to a unit at the surface of the earth, and a carrier contained within the drill string and carrying a portion of said flexible line in the form of a coil of many turns occupying a distance longitudinally of the drill string shorter than the length of the coiled portion of the line;

increasing the length of the drill string by connection of an additional pipe section thereinto at the surface of the earth; and at some point during the method exerting a pulling force longitudinally of the drill string between said line and carrier while the carrier is in said string and in a relation pulling a series of turns of said coil successively from said carrier, and from coiled condition to a straightened condition, to increase the effective length of the line and compensate for addition of said pipe section to the string.

20. The method that comprises:

drilling a hole into the earth utilizing a tubular drill string which is formed of interconnected pipe sections and which contains an instrument, a flexible condutive line extending from the instrument through the drill string toward the surface of the earth and electrically connectable to a unit at the surface of the earth, and a shuttle contained within the drill string near the surface of the earth and carrying a portion of said flexible line in the form of a coil of many turns occupying a distance longitudinally of the string shorter than the length of the coiled portion of the line;

increasing the length of the drill string by connection of an added pipe section thereinto at the surface of the earth;

moving said shuttle longitudinally within the drill string toward its outer end; and exerting a pulling force longitudinally of the drill string between said line and said shuttle as a result of said movement of the shuttle toward the outer end of the string and while the shuttle is in the string, and in a relation pulling a series of turns of said coiled flexible line successively from said shuttle, and from coiled condition to a straightened condition, to increase the effective length of the flexible line and compensate for addition of said pipe section thereto.

21. The method as recited in claim 20, in which said shuttle is moved toward the outer end of the drill string by exertion of pulling force thereagainst.

22. The method as recited in claim 20, in which said drill string has a circulating head and a second flexible line movable with said head and adapted to connect said first line to said unit; said movement of the shuttle toward the outer end of the drill string being effected by exerting pulling force on the shuttle by said circulating head through said second line.

23. The method as recited in claim 20, including threading a second flexible line through said added pipe section before connection thereof to the remainder of the drill string, and attaching said second flexible line to the shuttle, said step of moving the shuttle within the drill string toward the outer end thereof including pulling said shuttle through said added section of the drill string by pulling force exerted on the shuttle by said second flexible line.

24. The method that comprises:

drilling a hole in the earth utilizing a tubular drill string which is formed of interconnected pipe sections and which contains an instrument, a flexible line extending from the instrument through the drill string toward the surface of the earth, and a shuttle carrying a portion of said line in the form of a coil of many turns, said drill string having a circulating fluid head, and a second flexible line extending through said circulating head for connecting said first line to a unit at the surface of the earth;

detaching said circulating head from the end of the drill string;

connecting said circulating head to an additional pipe section to be added to the outer end of the drill string, with said second flexible line being threaded through said additional pipe section;

connecting an end of said second flexible line electrically to said first flexible line;

connecting said additional pipe section to the remainder of the drill string;

at some point during the method pulling said shuttle toward the surface of the earth within said additional pipe section by said second flexible line; and exerting a pulling force longitudinally of the drill string between said first flexible line and said shuttle during and as a result of said movement of the shuttle toward the surface of the earth and while the shuttle is in the drill string and in a relation pulling a series of turns of said coiled line successively from said shuttle, and from coiled condition to a straightened condition.

25. The method as recited in claim 24, including detaching said circulating head from said additional pipe section and disconnecting said second flexible line from said shuttle and said first flexible line after the shuttle has been pulled toward the surface of the earth within said additional section and after drilling has progressed to a point requiring addition of another section of the drill string.

26. Apparatus comprising:

a drill string including a series of interconnected pipe sections;

an instrument contained in said string;

a flexible conductive line extending from said instrument toward the surface of the earth;

a unit at the surface of the earth electrically connected to said flexible line; and a shuttle contained in the string near the surface of the earth and carrying a portion of said flexible line in the form of a coil of many turns occupying a distance longitudinally of the drill string shorter than the length of the coiled portion of the line;

said shuttle being movable within the drill string toward the surface of the earth when a pipe section is added to the string and being constructed to pay out the different turns of said coil successively from coiled condition to straightened condition during such movement of the shuttle in a relation increasing the length of the line between said instrument and said shuttle to compensate for the increase in length of the string;

said shuttle including a body by which said coiled portion of the flexible line is carried, and means carried by said body and engageable with the interior of the drill string and retaining said shuttle body against movement more deeply into the well while permitting movement of the shuttle body toward the surface of the earth.

27. Apparatus as recited in claim 26, in which said means include a cam mounted to said body for pivotal movement relative thereto about an axis extending generally transversely of the length of the drill string, said cam having a camming surface engageable with the inner surface of the drill string and which is eccentric with respect to the pivotal axis of the cam in a relation actuating the cam more tightly into gripping engagement with the wall of the drill string upon exertion of longitudinally inward force against said body to thereby prevent movement of the shuttle more deeply into the drill string, while by virtue of said eccentricity permitting movement of the shuttle longitudinally of the drill string toward the surface of the earth.

28. Apparatus as recited in claim 27, including spring means yieldingly urging said cam in a direction to release the gripping engagement thereof against the drill string, and a threaded adjusting fastener for adjusting the range of permitted pivotal movement of said cam and thereby adjusting the frictional resistance to longitudinal movement offered thereby.

29. Apparatus comprising:

a drill string including a series of interconnected pipe sections;

an instrument contained in said string;

a flexible conductive line extending from said instrument toward the surface of the earth;

a unit at the surface of the earth electrically connected to said flexible line;

a shuttle contained in the string near the surface of the earth and carrying a portion of said flexible line in the form of a coil of many turns occupying a distance longitudinally of the drill string shorter than the length of the coiled portion of the line;

said shuttle being movable within the drill string toward the surface of the earth when a pipe section is added to the string and being constructed to pay out the different turns of said coil successively from coiled condition to straightened condition during such movement of the shuttle in a relation increasing the length of the line between said instrument and said shuttle to compensate for the increase in length of the string;

said shuttle including a hollow body containing said coiled portion of the flexible line with the coil extending generally about the longitudinal axis of the drill string, binding material retaining said portion of the flexible line in said coiled condition and adapted to be progressively broken to release different turns of the coil successively, a friction drag unit for yieldingly resisting movement of the flexible line from said body, a plurality of elements carried by the body and engageable with the drill string in a relation preventing movement of the body more deeply into the drill string and permitting movement of the body toward the surface of the earth, and a first connector structure on the shuttle body for pulling it toward the surface of the earth;

a circulating head connectable to a pipe section to be added to the string;

a second flexible conductive line extending through said circulating head for connecting said unit to said first line electrically and having a portion projecting beyond the circulating head and of a length to extend through a pipe section secured to the circulating head; and a second connector structure carried by said second line and detachably connectable to said first connector structure in a relation enabling the shuttle to be pulled toward the surface of the earth by force exerted through said second flexible line and providing an electrical connection between the two lines.

30. A device for use in a drill string containing an instrument to be electrically connected with a unit at the surface of the earth, comprising:

a carrier adapted to be contained within the drill string; and a flexible conductive line for connecting said instrument electrically to said unit and carried by said carrier in the form of a coil of many turns occupying a distance longitudinally of the string shorter than the length of the coiled portion of the line;

said carrier being constructed to pay out different turns of said coil successively from the carrier, and from coiled condition to a straightened condition, to increase the effective length of the line and compensate for addition of a pipe section to the string;

said carrier including a hollow body;

said coil being contained within said hollow body and including a plurality of layers of said line wound one about the other;

a portion of said line which extends from said body being connected to the innermost of said layers of line in the coil in a relation to progressively unwind the line from the interior of the coil.

31. A device for use in a drill string containing an instrument to be electrically connected with a unit at the surface of the earth, comprising:

a carrier adapted to be contained within the drill string;

a flexible conductive line for connecting said instrument electrically to said unit and carried by said carrier in the form of a coil of many turns occupying a distance longitudinally of the string shorter than the length of the coiled portion of the line;

said carrier being constructed to pay out different turns of said coil successively from the carrier, and from coiled condition to a straightened condition, to increase the effective length of the line and compensate for addition of a pipe section to the string; and a binder material retaining said line in said coiled condition and adapted to be progressively broken to release the different turns of the coil successively by the exertion of longitudinal pulling force between the line and said carrier body.

32. A device for use in a drill string containing an instrument to be electrically connected with a unit at the surface of the earth, comprising:

a carrier adapted to be contained within the drill string; and a flexible conductive line for connecting said instrument electrically to said unit and carried by said carrier in the form of a coil of many turns occupying a distance longitudinally of the string shorter than the length of the coiled portion of the line;

said carrier being constructed to pay out different turns of said coil successively from the carrier, and from coiled condition to a straightened condition, to increase the effective length of the line and compensate for addition of a pipe section to the string;

said carrier including a unit engaging said flexible line and permitting movement of said line from the carrier but offering resistance thereto to maintain the line beyond the carrier in generally linear condition.

33. A device for use in a drill string containing an instrument to be electrically connected with a unit at the surface of the earth, comprising:

a carrier adapted to be contained within the drill string;

a flexible conductive line for connecting said instrument electrically to said unit and carried by said carrier in the form of a coil of many turns occupying a distance longitudinally of the string shorter than the length of the coiled portion of the line;

said carrier being constructed to pay out different turns of said coil successively from the carrier, and from coiled condition to a straightened condition, to increase the effective length of the line and compensate for addition of a pipe section to the string; and a wiper engaging the line as it discharges from the carrier and acting to remove foreign substances therefrom.

34. A device for use in a drill string containing an instrument to be electrically connected with a unit at the surface of the earth, comprising:

a carrier adapted to be contained within the drill string; and a flexible conductive line for connecting said instrument electrically to said unit and carried by said carrier in the form of a coil of many turns occupying a distance longitudinally of the string shorter than the length of the coiled portion of the line;

said carrier being constructed to pay out different turns of said coil successively from the carrier, and from coiled condition to a straightened condition, to increase the effective length of the line and compensate for addition of a pipe section to the string;

said carrier including a body by which said coiled portion of the flexible line is carried, and means carried by said body and engageable with the interior of the drill string in a relation to retain said carrier body against movement more deeply into the well while permitting movement of the body toward the surface of the earth.

35. A device as recited in claim 34, in which said means include a friction cam mounted to said body for pivotal movement relative thereto about an axis extending generally transversely of the length of the drill string, said cam having a camming surface engageable with the inner surface of the drill string and which is eccentric with respect to the pivotal axis of the cam in a relation actuating the cam more tightly into gripping engagement with the wall of the drill string upon exertion of longitudinally inward force against said body to thereby prevent movement of the carrier more deeply into the drill string, while by virtue of said eccentricity permitting movement of the carrier longitudinally of the drill string toward the surface of the earth.

36. A device as recited in claim 35, including spring means yieldingly urging said cam in a direction to release the gripping engagement thereof against the drill string, and a threaded adjusting fastener for adjusting the range of permitted pivotal movement of said friction cam and thereby adjusting the frictional resistance to longitudinal movement offered thereby.

* * * * *

UNITED STATES PATENT AND TRADEMARK OFFICE

CERTIFICATE OF CORRECTION

PATENT NO. : 4,325,438

DATED : April 20, 1982

INVENTOR(S) : Bernard R. Zuvela

It is certified that error appears in the above—identified patent and that said Letters Patent is hereby corrected as shown below:

Column 11, line 17, replace "17" with --14--.

Signed and Sealed this

*Twelfth* Day of *October 1982*

[SEAL]

*Attest:*

GERALD J. MOSSINGHOFF

*Attesting Officer*

*Commissioner of Patents and Trademarks*